US006419164B1

(12) United States Patent
Heinz et al.

(10) Patent No.: US 6,419,164 B1
(45) Date of Patent: Jul. 16, 2002

(54) FUEL INJECTION VALVE FOR INTERNAL COMBUSTION ENGINES

(75) Inventors: Rudolf Heinz, Renningen; Dieter Kienzler, Leonberg; Klaus-Peter Schmoll, Lehrensteinsfeld; Friedrich Boecking, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/673,358

(22) PCT Filed: Nov. 30, 1999

(86) PCT No.: PCT/DE99/03782

§ 371 (c)(1),
(2), (4) Date: Dec. 29, 2000

(87) PCT Pub. No.: WO00/49285

PCT Pub. Date: Aug. 24, 2000

(30) Foreign Application Priority Data

Feb. 15, 1999 (DE) ..... 199 06 266

(51) Int. Cl.[7] ..... F02M 47/02

(52) U.S. Cl. ..... 239/88; 239/102.2; 239/126; 239/533.2; 239/533.9

(58) Field of Search ..... 239/88, 91, 102.1, 239/102.2, 124, 126, 533.1, 533.2, 533.3, 533.8, 533.9, 584

(56) References Cited

U.S. PATENT DOCUMENTS 4,814,659 A * 3/1989 Sawada ..... 310/328
5,482,213 A * 1/1996 Matsusaka et al. ..... 239/584
5,630,550 A * 5/1997 Kurishige et al. ..... 239/533.8

* cited by examiner

*Primary Examiner*—William C. Doerrler
*Assistant Examiner*—Christopher Kim
(74) *Attorney, Agent, or Firm*—Ronald E. Greigg

(57) ABSTRACT

The invention relates to a fuel injection valve that has a valve member which can control a fuel outlet opening. The valve member has a first opening surface, which defines a first opening pressure chamber in the opening direction of the valve member, wherein the first opening pressure chamber is connected to a high-pressure fuel source and the pressure in the first opening pressure chamber produces a first opening force against the first opening surface. The valve member also has a first closing surface, which defines a first closing pressure chamber in the closing direction of the valve member, wherein the first closing pressure chamber is connected to the high-pressure fuel source and the pressure in the first closing pressure chamber produces a first closing force against the first closing surface.

20 Claims, 1 Drawing Sheet

FUEL INJECTION VALVE FOR INTERNAL COMBUSTION ENGINES

CROSS-REFERENCES TO RELATED APPLICATIONS

This is a 35 USC 371 application of PCT/DE 99/03782 filed on Nov. 30, 1999.

The invention is based on a fuel injection valve for internal combustion engine.

DE has disclosed a fuel injection valve which contains a valve member that is supported so that the valve member can move bidirectionally, wherein a fuel outlet opening can be controlled with the valve member. In the known fuel injection valve, the valve member has a first opening surface, which defines a first opening pressure chamber in the opening direction of the valve member. The first opening pressure chamber is connected to a high-pressure fuel source and wherein the pressure in the first opening pressure chamber produces a first opening force against the first opening surface. In addition, the valve member has a first closing surface, which defines a first closing pressure chamber in the closing direction of the valve member. The first closing pressure chamber is connected to the high-pressure fuel source and wherein the pressure in the first closing pressure chamber produces a first closing force against the first closing surface.

In the known fuel injection valve, the connection of the first closing pressure chamber to the high-pressure fuel source is produced by means of a throttle location. In addition, the first closing pressure chamber communicates with a discharge chamber that is connected to a relatively pressure-free reservoir. The connection of the first closing pressure chamber to the relatively pressure-free discharge chamber can be switched open and closed with a control valve. When an injection event is to be executed, i.e. when the valve member is to be actuated, the control valve is actuated to open the connection between the first closing pressure chamber and the discharge pressure chamber. Since more fuel flows out of the first closing pressure chamber into the discharge pressure chamber when the control valve is open than can flow through the throttled connection with the high-pressure fuel source into the first closing pressure chamber, a pressure drop occurs in the first closing pressure chamber. The pressure drop reduces the first closing force. As a result, the first opening force prevails and the valve member is moved axially so that the valve member unblocks the fuel outlet opening. In order to end the injection event, the control valve is actuated to close the connection between the discharge pressure chamber and the first closing pressure chamber. Due to the connection of the first closing pressure chamber to the high-pressure fuel source, the original closing force can be rapidly reinstated against the first closing surface in the first closing pressure chamber so that the valve member closes the fuel outlet opening once more.

In the known fuel injection valve, since relatively small forces, which must be exerted to adjust the control valve, generate relatively large forces against the valve member in order to move the valve member, in fuel injection valves that operate according to this principle, reference is often made to an indirect valve member control or actuation or to a "servo principle".

Although the fuel injection valves operating according to this servo principle have proven themselves in actual use, embodiments are continuously being sought which permit even shorter control times for the fuel injection valve in order to improve the emissions levels, efficiency, and noise generation of the internal combustion engines that are operated using them, in particular diesel engines.

ADVANTAGES OF THE INVENTION

With the fuel injection valve according to the invention, it is now possible to achieve shorter control times for the actuation of the valve member so that smaller fuel injection quantities can be more precisely metered and more precisely defined injection times can be achieved. The invention is based on the general concept of producing, with the aid of the first opening force and the first closing force against the valve member, a quasi-static force equilibrium which is essentially maintained even during the adjusting movements of the valve member. The forces required for the adjustment of the valve member are then introduced by the actuating means directly onto the valve member in the form of an additional, second opening force, wherein this second opening force can be relatively small and is essentially independent of the pressure levels prevailing in the first opening pressure chamber and the first closing pressure chamber. In contrast to the known fuel injection valve mentioned at the beginning, in this instance, a direct actuation or control of the valve member is thus produced. Preferably, the first closing pressure chamber is connected in a virtually unthrottled manner to the high-pressure fuel source. In particular, the first closing pressure chamber can communicate directly with the first opening pressure chamber.

These measures assure that the pressures in the first closing pressure chamber and in the first opening pressure chamber remain constant or behave in virtually the same manner so that the static pressure equilibrium always prevails against the valve member.

In a preferred embodiment of the fuel injection valve according to the invention, the actuation means can have a pressure generator which can adjust a working pressure in a second opening pressure chamber in order to open the valve member. In addition, the valve member can then have a second opening surface which defines the second opening pressure chamber in the opening direction of the valve member, wherein the working pressure in the second opening pressure chamber produces the second opening force against the second opening surface. This kind of hydraulic force transmission is particularly easy to produce and permits a relatively abrasion-free actuation of the valve member. Preferably, the above-mentioned pressure generator drives a piston which defines a working pressure chamber that communicates with the second opening pressure chamber. In this manner, for example, a hydraulic transmission can easily be produced. For example, if a piezoelectric actuator is used as the pressure generator, a relatively small stroke of the piezoelectric actuator can be converted into a relatively large stroke of the valve member by means of this hydraulic transmission.

So that the actuating means only has to produce an opening force and no closing force in order to move the valve member, the first closing force can preferably be selected so that it is slightly greater than the first opening force so that the valve member automatically closes in the absence of a second opening force. Likewise, additional spring means can be provided which drive the valve member into its closed position.

In a preferred embodiment, the first closing pressure chamber can be embodied at an axial end of the valve member remote from the fuel outlet opening, which produces a particularly simple design.

In order to control the fuel outlet opening, the valve member is provided with a sealing zone which cooperates with a corresponding sealing seat. When the valve member opens, this sealing zone lifts up from the valve seat so that the high fuel pressure prevailing against the valve member can act in the opening direction against this sealing zone as well, and against the entire axial end of the valve member oriented toward the fuel outlet opening. As a result, the valve member experiences an additional force in the opening direction which can affect the dynamic opening behavior of the valve member. This property makes it more difficult to meter small fuel injection quantities in which a rapid and reliable closing of the valve member must be produced, particularly before its arrival at an upper or open end position of the valve member. In order to balance this additional opening force during the opening of the valve member, in the fuel injection valve according to the invention, the valve member can have a second closing surface which defines a second closing pressure chamber in the closing direction of the valve member, wherein the pressure in the second closing pressure chamber produces a second closing force against the second closing surface. In addition, a compensation piston can then be provided which on the one hand, defines a compensation pressure chamber that communicates with the second closing pressure chamber, and on the other hand, defines a reference pressure chamber. A pressure increase produced in the second closing pressure chamber by an opening movement of the valve member is limited by the pressure in the reference pressure chamber, which is preferably connected to the high-pressure fuel source, and with a continuing opening motion of the valve member. The pressure in the second closing pressure chamber remains essentially constant as a result of a corresponding adjustment of the compensation piston. In this embodiment, even with the first opening movement of the valve member, a pressure can build up in the second closing pressure chamber which increases very rapidly to a maximum value. Then the pressure remains constant since the position of the compensation piston can change after a particular pressure and as a result, the total volume in the compensation pressure chamber and in the second closing pressure chamber remains constant.

In an advantageous improvement of the above-mentioned embodiment, the compensation pressure chamber and the second closing pressure chamber can be connected via a check valve to a fuel supply. The check valve is oriented so that the check valve opens when there is negative pressure in the compensation pressure chamber and in the second closing pressure chamber and closes when there is excess pressure in the compensation pressure chamber and in the second closing pressure chamber. This additional measure can compensate for leakage losses which can preferably be produced when the valve member is opened and the pressure compensation takes place via the second closing pressure chamber and the compensation pressure chamber.

According to a particularly advantageous embodiment, a fuel network can be provided which has a fuel pressure source whose pressure is greater than the ambient pressure and less than the pressure of the high-pressure fuel source. This fuel network has at least one pressure chamber, which is disposed against an axially adjustable element of the fuel injection valve, axially between a high-pressure region embodied against this element and a low-pressure region embodied against this element. This measure considerably reduces the pressure differential between the respective high-pressure region and low-pressure region by constituting a series of stages. In this connection, the pressure differential between the high-pressure region and the pressure chamber constitutes a first stage and the pressure differential between the pressure chamber and the low-pressure region constitutes a second stage. This results in the fact that considerably smaller leaks occur. At the pressures and adjusting speeds that occur in a fuel injection valve, leaks can trigger cavitations, which lead to damage to the valve member or to the fuel injection valve.

Other important features and advantages of the fuel injection valve according to the invention ensue from the claims, the drawing, and the accompanying Fig. description in conjunction with the drawing.

BRIEF DESCRIPTION OF THE DRAWING

A preferred exemplary embodiment of the fuel injection valve according to the invention is shown in the drawing and will be explained in detail below.

DESCRIPTION OF THE EXEMPLARY EMBODIMENT

Figure 1:
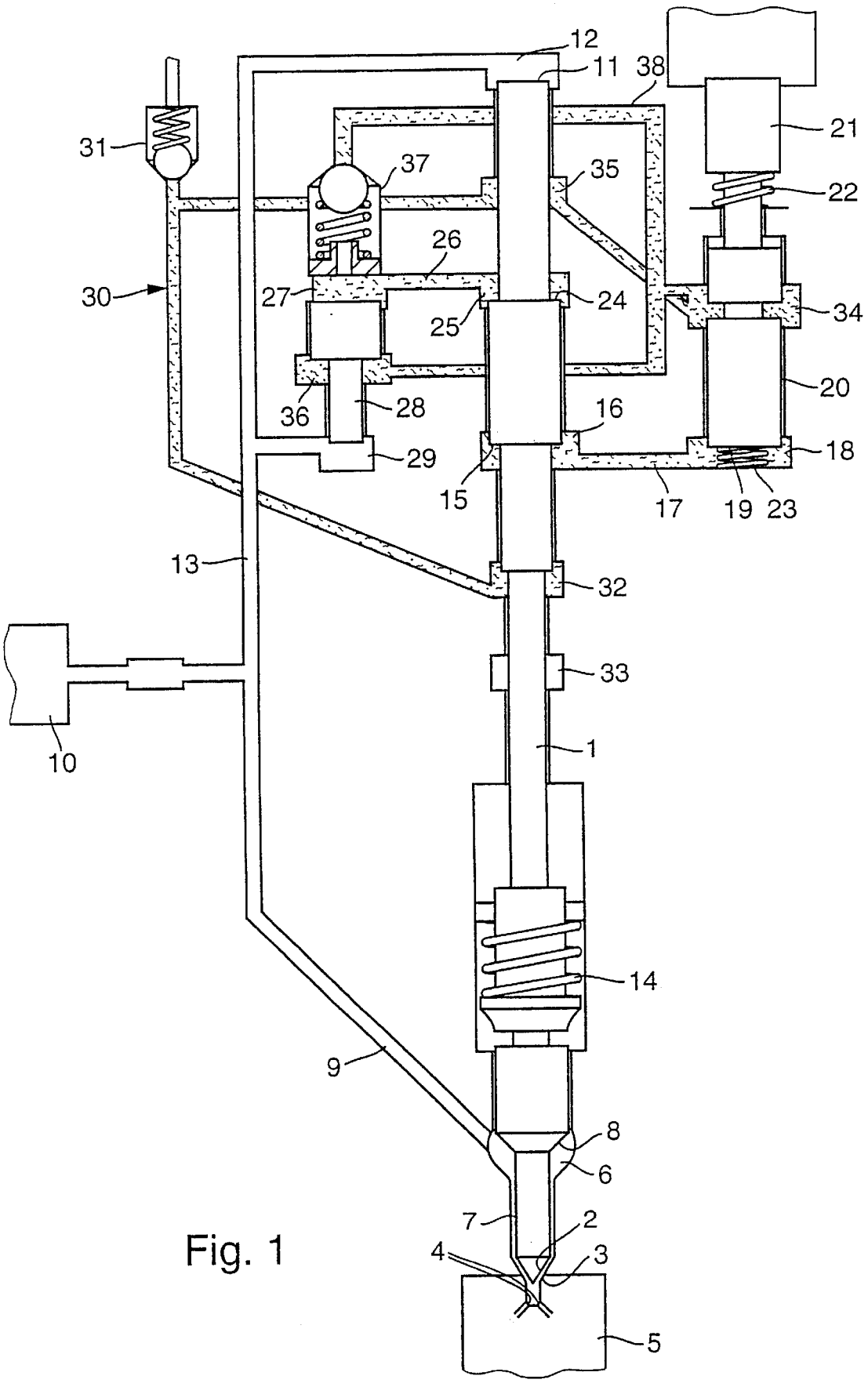
FIG. 1 is a schematic representation of a design of a fuel injection valve according to the invention.

According to FIG. 1, a fuel injection valve has a rod-shaped or needle-shaped valve member 1, which is supported in the fuel injection valve so that the valve member can move bidirectionally in its axial direction. On its lower axial end according to FIG. 1, the valve member 1 has a pointed sealing zone 2, which cooperates with a valve seat 3 which has fuel outlet openings 4 disposed in the end. The fuel outlet openings 4 feed into a combustion chamber 5 of an internal combustion engine that is otherwise not shown, preferably a diesel engine. The fuel outlet opening 4 is controlled, i.e. opened or closed, with the valve member 1 or with its sealing zone 2.

A first opening pressure chamber 6 is disposed upstream of the fuel outlet openings 4 and communicates with the fuel outlet openings 4 via an annular chamber 7 and is defined by a first opening surface 8 in the opening direction of the valve member 1, i.e. in a direction pointing away from the valve seat 3. The first opening pressure chamber 6 communicates via a high-pressure line 9 connected with a high-pressure fuel source 10, which can, for example, be the high-pressure accumulation line of a common rail system. When the internal combustion engine is operating, the high fuel pressure consequently prevails in the first opening pressure chamber 6 and a first opening force, which engages the valve member 1 and is directed upward according to FIG. 1, is produced against the first opening surface 8.

On the axial end of the valve member 1 opposite from the sealing zone 2, a first closing surface 11 is embodied on the valve member 1 and defines a first closing pressure chamber 12 in the closing direction of the valve member 1, i.e. in the direction pointing toward the valve seat 3. This first closing pressure chamber 12 also communicates with the high-pressure fuel source 10 via a corresponding pressure line 13. Consequently, a first closing pressure is produced in the first closing pressure chamber 12 against the first closing surface 11, which engages the valve member 1 and acts from the top toward the bottom according to FIG. 1. As a result of the choice of the sizes for the first opening surface 8 and for the first closing surface 11, an essentially static force equilibrium can be produced on the valve member 1, in such a way that only relatively small forces are required in order to move the valve member 1 to control the fuel outlet openings 4. Preferably, the first closing force is slightly greater than the first opening force so that the valve member 1 automatically closes or remains in its closed position. Moreover, spring means 14 can engage the valve member 1 in order to prestress the valve member 1 in its closed position.

In addition, a second opening surface 15 is embodied on the valve member, which defines a second opening pressure chamber 16 in the opening direction of the valve member 1. This second opening pressure chamber 16 is connected so that the pressure chamber 16 communicates with a working pressure chamber 18 via a connecting line 17. An axial end or an end face 19 of a working piston 20 protrudes into the working pressure chamber 18 and is driven in an axially adjustable manner by a piezoelectric actuator 21 that is not described in detail. Spring means 22 and 23 are used to restore the piston 20. The pressure prevailing in the working pressure chamber 18 and in the second opening pressure chamber 16 produces an additional, second opening force against the second opening surface 15, which force engages the valve member 1, is directed upward according to FIG. 1, and is added to the first opening force against the first opening surface 8.

Furthermore, a second closing surface 24 is embodied on the valve member 1 and defines a second closing pressure chamber 25 in the closing direction of the valve member 1. This second closing pressure chamber 25 communicates via a connecting line 26 with a compensation pressure chamber 27 that is defined on one side by a compensation piston 28. On the side remote from the compensation pressure chamber 27; this compensation piston 28 defines a reference pressure chamber 29, which communicates with the high-pressure line 13 and consequently with the high-pressure fuel source 10 so that the high fuel pressure here constitutes the reference pressure. The compensation piston 28 is driven by a force differential on its axial end faces, i.e. by means of a pressure differential between the pressures in the reference pressure chamber 29 and in the compensation pressure chamber 27, wherein the surface areas exposed to the pressures must be taken into account. The pressure prevailing in the compensation pressure chamber 27 and consequently also in the second closing pressure chamber 25 produces a second closing force against the second closing surface 24, which force engages the valve member 1 and is directed downward according to FIG. 1.

The fuel injection valve according to the invention is also equipped with a fuel network 30, which is kept at a predetermined average network pressure level by means of a check valve 31 that functions as a pressure relief valve. This network pressure is greater than the ambient pressure and less than the high pressure of the high-pressure fuel source 10. If the pressure prevailing in the fuel network 30 exceeds the predetermined network pressure, the check valve 31 opens and the fuel can preferably escape into a fuel tank that is not shown.

The fuel network 30 has a first pressure chamber 32 which communicates with the check valve 31. The first pressure chamber 32 is disposed against the valve member 1, axially between the first opening pressure chamber 6 and the second opening pressure chamber 16. In particular, this first pressure chamber 32 is disposed axially between the second opening pressure chamber 16 and an ambient pressure chamber 33 disposed against the valve member 1, through which a leakage is conveyed back into the fuel tank. The first pressure chamber 32 consequently divides the pressure differential between the second opening pressure chamber 16 and the ambient pressure chamber 33 into two stages, with a first smaller pressure differential between the second opening pressure chamber 16 and the first pressure chamber 32, and a second smaller pressure differential between the first pressure chamber 32 and the ambient pressure chamber 33. The leakage quantity can be reduced by means of this measure.

A second pressure chamber 34 of the fuel network 30 is disposed against the piston 20 of the pressure generator 21 that is embodied as a piezoelectric actuator. The second pressure chamber 34, which likewise communicates with the pressure control valve 31 is consequently disposed between the working pressure chamber 18 and the actual pressure generator 21 or the ambient pressure and constitutes a pressure stage there.

A third pressure chamber 35 is likewise disposed against the valve member 1, but between the first closing pressure chamber 12 and the second closing pressure chamber 25. Consequently, the third pressure chamber 35 constitutes a pressure stage between the high-pressure level of the first closing pressure chamber 12 and the relatively low pressure in the second closing pressure chamber 25.

A fourth pressure chamber 36 of the fuel network 30 is disposed against the compensation piston 28 and separates the reference pressure chamber 29 that has a relatively high pressure from the compensation pressure chamber 27 that has a relatively low pressure. The third pressure chamber 35 and the fourth pressure chamber 36 also communicate with the check valve 31.

Fuel network the 30 is consequently filled with fuel and brought to network pressure exclusively by means of leaks from the respective high-pressure regions into the pressure chambers 32, 34, 35, 36 of the fuel network 30.

The compensation pressure chamber 27 communicates with the fuel network 30 via a check valve 37 and a corresponding connecting line 38. The check valve 37 closes when there is excess pressure in the compensation pressure chamber 27 in relation to the fuel network 30 and opens when there is a negative pressure in the compensation pressure chamber 27 in relation to the fuel network 30.

The fuel injection valve according to the invention functions as follows:

When the pressure generator 21 is not actuated, the opening and closing forces acting on the valve member 1 produce a resulting force acting in the closing direction so that the sealing zone 2 rests in the valve seat 3 and the fuel outlet openings 4 are closed. In order to open the fuel outlet openings 4 or to move the valve member 1 in the opening direction, the pressure generator 21 is preferably electrically actuated, as a result of which the pressure generator moves the piston 20 axially into the working chamber 18. As a result of the displacing action of the piston 20, a pressure increase occurs in the working chamber 18 and consequently also in the second opening pressure chamber 16, which produces a second opening force against the second opening surface 15, which is sufficient to lift the valve member 1 up from the valve seat 3. The additional opening force required to initiate this opening movement of the valve member 1 is relatively small since the large static forces acting on the valve member 1 due to the high pressures in the high-pressure fuel supply are essentially in equilibrium, i.e. they cancel each other out.

As soon as the sealing zone 2 lifts up from the valve seat 3, the high fuel pressure also prevails downstream of the sealing zone 2 so that an additional dynamic opening force is produced against the valve member 1. As a result of the adjusting stroke of the valve member 1, however, a pressure increase is simultaneously produced by the second closing surface 24 in the second closing pressure chamber 25 and an additional closing force is consequently produced, which largely cancels out the undesired effect of the above-described additional dynamic opening force against the sealing zone 2. Upon achievement of a predetermined pressure in the second closing pressure chamber 25 and consequently in the compensation pressure chamber 27, the compensation piston 28 moves into the reference pressure chamber 29, which results in the fact that the pressure in the second closing pressure chamber 25 and the compensation pressure chamber 27 remain constant and consequently, so does the second closing force.

The coupling of the first pressure chamber 12 with the high-pressure fuel source 10 according to the invention can essentially cancel out the static forces acting on the valve member 1. By means of the proposed compensation device with the second closing pressure chamber 25, compensation pressure chamber 27, and compensation piston 28, the dynamic forces acting on the valve member 1 can also be compensated for. These measures result in the fact that the valve member 21 can be actuated directly with the pressure forces that can be produced by the pressure generator 21 so that a servo mechanism or the like is superfluous. The "direct" triggering of the valve member 1 according to the invention consequently permits the valve member to achieve very short actuation times for the valve member 1 as a result of which, the fuel outlet openings 4 can be opened at predetermined times, with a high degree of precision, and for very short periods, in order to purposely inject correspondingly small fuel quantities.

In the course of an opening motion, leakage can cause fuel to escape from the compensation pressure chamber 27 into the fourth pressure chamber 36 or from the second closing pressure chamber 25 into the second opening pressure chamber 16 or into the third pressure chamber 35 so that in a subsequent closing motion of the valve member 1—as soon as the compensation piston 28 has reached its upper end position according to FIG. 1, a negative pressure with an attendant cavitation risk would be produced in the compensation pressure chamber 27 and in the second closing pressure chamber 25. In order to prevent this, the check valve 37 promptly opens as a result of which the missing fuel volume can be compensated for.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve comprising a valve member (1), which is supported so that the valve member moves bidirectionally to control a fuel outlet opening (4), the valve member (1) has a first pressure opening surface (8), the first pressure opening surface defines an upper portion of a first pressure opening chamber (6), the first pressure opening chamber (6) is connected to a high-pressure fuel source (10) and the pressure in the first opening pressure chamber (6) produces a first pressure opening force against the first opening surface (8), the valve member (1) has a first closing surface (11), the first closing surface defines a lower portion of a first closing pressure chamber (12), the first closing pressure chamber (12) is connected to the high-pressure fuel source (10) and the pressure in the first closing pressure chamber (12) produces a first closing force against the first closing surface (11), actuating means (15, 16, 18, 20, 21) are provided, which introduce a second opening force onto the valve member (1) in order to open the valve member (1), and the second opening force acts on the valve member (1) in addition to the first opening force, the valve member (1) has a second closing surface (24) which defines a lower portion of a second closing pressure chamber (25), wherein the pressure in the second closing pressure chamber (25) produces a second closing force against the second closing surface (24), a compensation piston (28) is provided which defines a compensation pressure chamber (27) that communicates with the second closing pressure chamber (25), and defines a reference pressure chamber (29), a pressure increase produced in the second closing pressure chamber (25) by an opening movement of the valve member (1) is limited by the pressure in the reference pressure chamber (29), which is connected to the high-pressure fuel source (10), with a continuing opening motion of the valve member (1), the pressure in the second closing pressure chamber (25) remains essentially constant as a result of a corresponding adjusting motion of the compensation piston (28), the compensation pressure chamber (27) and the second closing pressure chamber (25) are connected to a fuel supply (38) via a check valve (37), wherein the check valve (37) is oriented so that the check valve opens when there is negative pressure in the compensation pressure chamber (27) and in the second closing pressure chamber (25), and closes when there is an excess pressure in the compensation pressure chamber (27) and in the second closing pressure chamber (25).

2. The fuel injection valve according to claim 1, in which the at least one pressure chamber includes a fourth pressure chamber (36) which is disposed against the compensation piston (28) between the compensation pressure chamber (27) and the reference pressure chamber (29).

3. The fuel injection valve according to claim 1, in which a fuel supply (38) of the compensation pressure chamber (27) and of the second closing pressure chamber (25) is constituted by a fuel network (30).

4. A fuel injection valve comprising a valve member (1), which is supported so that the valve member moves bidirectionally to control a fuel outlet opening (4), the valve member (1) has a first pressure opening surface (8), the first pressure opening surface defines an upper portion of a first pressure opening chamber (6), the first pressure opening chamber (6) is connected to a high-pressure fuel source (10) and the pressure in the first opening pressure chamber (6) produces a first pressure opening force against the first opening surface (8), the valve member (1) has a first closing surface (11), the first closing surface defines a lower portion of a first closing pressure chamber (12), the first closing pressure chamber (12) is connected to the high-pressure fuel source (10) and the pressure in the first closing pressure chamber (12) produces a first closing force against the first closing surface (11), actuating means (15, 16, 18, 20, 21) are provided, which introduce a second opening force onto the valve member (1) in order to open the valve member (1), and the second opening force acts on the valve member (1) in addition to the first opening force, a fuel network (30) is provided, in which a network pressure can be adjusted, in which the pressure is greater than the ambient pressure and less than the pressure of the high-pressure fuel source (10), the fuel network (30) has at least one pressure chamber (32, 34, 35, 36), which is disposed against an axially adjustable element including one of a valve member (1), a piston (20), and a compensation piston (28) of the fuel injection valve, axially between a high-pressure region and a low-pressure region of the adjustable valve member (1), piston (20), and compensation piston (28), wherein the network pressure prevails in the at least one pressure chamber (32, 34, 35, 36) of the fuel network (30).

5. The fuel injection valve according to claim 4, in which the at least one pressure chamber includes a first pressure chamber (32) which is disposed against the valve member (1) between the first opening pressure chamber (6) and a second opening pressure chamber (16).

6. The fuel injection valve according to claim 4, in which the at least one pressure chamber includes a second pressure chamber (35) which is disposed against the valve member (1) between the first closing pressure chamber (12) and a second closing pressure chamber (25).

7. The fuel injection valve according to claim 5, in which the at least one pressure chamber includes a second pressure chamber (35) which is disposed against the valve member (1) between the first closing pressure chamber (12) and a second closing pressure chamber (25).

8. The fuel injection valve according to claim 4, in which the at least one pressure chamber includes a third pressure chamber (34) which is disposed against the piston (20) between a working pressure chamber (18) and a pressure generator.

9. The fuel injection valve according to claim 5, in which the at least one pressure chamber includes a third pressure chamber (34) which is disposed against the piston (20) between a working pressure chamber (18) and a pressure generator.

10. The fuel injection valve according to claim 6, in which the at least one pressure chamber includes a third pressure chamber (34) which is disposed against the piston (20) between a working pressure chamber (18) and a pressure generator.

11. The fuel injection valve according to claim 4, in which the at least one pressure chamber includes a fourth pressure chamber (36) is disposed against the compensation piston (28) between a compensation pressure chamber (27) and a reference pressure chamber (29).

12. The fuel injection valve according to claim 5, in which the at least one pressure chamber includes a fourth pressure chamber (36) which is disposed against the compensation piston (28) between the compensation pressure chamber (27) and a reference pressure chamber (29).

13. The fuel injection valve according to claim 6, in which the at least one pressure chamber includes a fourth pressure chamber (36) which is disposed against the compensation piston (28) between a compensation pressure chamber (27) and a reference pressure chamber (29).

14. The fuel injection valve according to claim 8, in which the at least one pressure chamber includes a fourth pressure chamber (36) which is disposed against a compensation piston (28) between a compensation pressure chamber (27) and a reference pressure chamber (29).

15. The fuel injection valve according to claim 4, in which a fuel supply (38) of a compensation pressure chamber (27) and of a second closing pressure chamber (25) is constituted by a fuel network (30).

16. The fuel injection valve according to claim 5, in which a fuel supply (38) of a compensation pressure chamber (27) and of a second closing pressure chamber (25) is constituted by a fuel network (30).

17. The fuel injection valve according to claim 6, in which a fuel supply (38) of a compensation pressure chamber (27) and of a second closing pressure chamber (25) is constituted by a fuel network (30).

18. The fuel injection valve according to claim 8, in which a fuel supply (38) of a compensation pressure chamber (27) and of a second closing pressure chamber (25) is constituted by a fuel network (30).

19. The fuel injection valve according to claim 11, in which a fuel supply (38) of a compensation pressure chamber (27) and of a second closing pressure chamber (25) is constituted by a fuel network (30).

20. A fuel injection valve comprising a valve member (1), which is supported so that the valve member moves bidirectionally to control a fuel outlet opening (4), the valve member (1) has a first pressure opening surface (8), the first pressure opening surface defines an upper portion of a first pressure opening chamber (6), the first pressure opening chamber (6) is connected to a high-pressure fuel source (10) and the pressure in the first opening pressure chamber (6) produces a first pressure opening force against the first opening surface (8), the valve member (1) has a first closing surface (11), the first closing surface defines a lower portion of a first closing pressure chamber (12), the first closing pressure chamber (12) is connected to the high-pressure fuel source (10) and the pressure in the first closing pressure chamber (12) produces a first closing force against the first closing surface (11), actuating means (15, 16, 18, 20, 21) are provided, which introduce a second opening force onto the valve member (1) in order to open the valve member (1), and the second opening force acts on the valve member (1) in addition to the first opening force, the actuating means includes a piezoelectric actuator pressure generator (21) and a second opening pressure chamber (16) in which the piezoelectric actuator pressure generator (21) adjusts a working pressure in the second opening pressure chamber (16) in order to open the valve member (1) and the valve member (1) has a second opening surface (15) actuating means which defines an upper portion of the second opening pressure chamber (16), and the working pressure in the second opening pressure chamber (16) produces the second opening force against the second opening surface (15), the actuation means includes a piston (20) and the pressure generator (21) drives the piston (20) which includes an axial end face (19), the axial end face (19) defines a working pressure chamber (18) actuating means that communicates with the second opening pressure chamber (16), a third pressure chamber (34) is disposed against the piston (20) between the working pressure chamber (18) and a pressure generator.

* * * * *